US008283099B2

(12) United States Patent
Huang et al.

(10) Patent No.: US 8,283,099 B2
(45) Date of Patent: Oct. 9, 2012

(54) BIOMASS CHEMICAL TONER COMPOSITION AND METHOD FOR MANUFACTURING THE SAME

(75) Inventors: Kuo-Tung Huang, Hsinchu County (TW); Ju-Feng Liao, Hsinchu (TW); I-Jein Cheng, Changhua (TW); Jui-Fa Chang, Hsinchu (TW); Yu-Chin Lin, Hsinchu County (TW); Hsiang-Yun Lee, Hsinchu County (TW); Yu-Ying Hsu, Changhua County (TW)

(73) Assignee: Industrial Technology Research Institute, Hsinchu County (TW)

( * ) Notice: Subject to any disclaimer, the term of this patent is extended or adjusted under 35 U.S.C. 154(b) by 310 days.

(21) Appl. No.: 12/729,200

(22) Filed: Mar. 22, 2010

(65) Prior Publication Data

US 2011/0143276 A1 Jun. 16, 2011

(30) Foreign Application Priority Data

Dec. 16, 2009 (TW) ..... 98143079 A

(51) Int. Cl.
*G03G 9/08* (2006.01)

(52) U.S. Cl. ..... 430/110.2; 430/137.13; 430/137.14

(58) Field of Classification Search ..... 430/110.2, 430/137.13, 137.14
See application file for complete search history.

(56) References Cited

U.S. PATENT DOCUMENTS

| | | | | |
|---|---|---|---|---|
| 3,974,078 | A * | 8/1976 | Crystal | 430/110.2 |
| 6,432,600 | B2 | 8/2002 | Suwa et al. | |
| 7,846,633 | B2 * | 12/2010 | Nakamura et al. | 430/110.2 |
| 2001/0003636 | A1 | 6/2001 | Suwa et al. | |
| 2003/0165764 | A1 | 9/2003 | Suwa et al. | |
| 2009/0011355 | A1 * | 1/2009 | Shibai | 430/109.1 |

FOREIGN PATENT DOCUMENTS

| | | | |
|---|---|---|---|
| EP | 1107069 | A1 | 6/2001 |
| EP | 1255166 | A2 | 11/2002 |
| JP | 9-281746 | A | 10/1997 |
| JP | 10-142911 | A | 5/1998 |
| JP | 2001-22123 | A | 1/2001 |
| JP | 2004-93829 | A | 3/2004 |
| JP | 2008-250171 | A | 10/2008 |
| JP | 2008-262179 | A | 10/2008 |

* cited by examiner

*Primary Examiner* — Mark A Chapman
(74) *Attorney, Agent, or Firm* — Pai Patent & Trademark Law Firm; Chao-Chang David Pai

(57) ABSTRACT

Disclosed are a biomass chemical toner composition and a method for manufacturing the same. First, a biomass resin is mixed with a first hydrophobic resin to form organic particles. The organic particles, a second hydrophobic resin, and a pigment are mixed by emulsion aggregation to form cores. Subsequently, a third hydrophobic resin is formed on the surface of the cores, and the third hydrophobic resin is further heated and coalesced to form a continuous structure encapsulating the cores. Accordingly, the biomass chemical toner obtained from the described method has good anti-humidity, good charge stability, and low fusing temperature.

24 Claims, No Drawings

BIOMASS CHEMICAL TONER COMPOSITION AND METHOD FOR MANUFACTURING THE SAME

CROSS REFERENCE TO RELATED APPLICATIONS

This application claims priority of Taiwan Patent Application No. 098143079, filed on Dec. 16, 2009, the entirety of which is incorporated by reference herein.

BACKGROUND OF THE INVENTION

1. Field of the Invention

The present invention relates to biomass chemical materials, and in particular relates to a toner composition utilizing the biomass chemical materials and method for manufacturing the same.

2. Description of the Related Art

Recently, laser printers or photostats are necessary pieces of equipment for offices and homes. Toner is the major consumable material of printers, and it should have a good humidity resistance and a low fusing temperature. In light of environmental protection and energy-efficiency concerns, the manufacturers of the printer toner have replaced high temperature kneader mixing type toner with milder chemical methods.

Although the chemical toner has several advantages such as low temperature manufacturing, energy efficiency, and low $CO_2$ emission, it still produces waste powder when printing or when printed papers are recycled. The waste powder is usually treated by means of combustion or burying. However, the chemicals of the waste powder include acrylate-styrene copolymer or polyester, which come from petroleum, it is not bio-degradable.

In order to solve the waste powder problem, recyclable or biodegradable resins are adopted. However, the costs of using 100% recyclable material are too high to be accepted in this market. Biomass resins such as poly(lactic acid), polycaprolactone, polyhydroxyalkanoate, and similar substances have problems (e.g. water absorption problem and poor processing properties) which must be overcome. As disclosed in U.S. Pat. No. 6,432,600, the toner is made by mixing the terpene-phenol copolymer with 20% poly(lactic acid), wherein the terpene-phenol copolymer is used to enhance anti-humidity qualities which further improves the charge stability. However, the manufacturing process of the toner is a conventional kneader process. In EP1255166, the toner is made of biodegradable polyhydroxyalkanoate (PHA) by a mechanical kneader. However, the raw material must be modified with high cost and its humidity absorption problems still remains. In JP2001022123, the polyester, having low melting point and specific structure, is blended with poly(lactic acid) to form the toner resin, thereby reducing the fusing temperature and preventing the poly(lactic acid) from degrading at high temperature. In JP 2008262179, the modified poly(lactic acid) and modified polyester is adopted to lower the fusing temperature of the toner. The toner is manufactured in water by solvent grinding, and the preparation of the toner still faces the solvent removal problem.

Accordingly, a novel method of manufacturing toner is called for which can save energy, lower costs, and reduce the environmental impact.

BRIEF SUMMARY OF THE INVENTION

The invention provides a biomass chemical toner composition, comprising a core and a shell which encapsulate around the core, wherein the shell is a continuous structure; wherein the core is a mixture of an organic particle, a second hydrophobic resin, and a pigment, wherein the organic particle is composed of a biomass resin and a first hydrophobic resin; and wherein the core is a mixture of an organic particle composed of a biomass resin and a first hydrophobic resin, a second hydrophobic resin, and a pigment; and wherein the shell is composed of a third hydrophobic resin.

The invention also provides a method for preparing the biomass chemical toner composition which comprises forming an organic particle of a biomass resin and a first hydrophobic resin; mixing the organic particle, a second hydrophobic resin, and a pigment to form a core; forming a third hydrophobic resin on the surface of the core; and heating and coalescing the third hydrophobic resin to form a continuous shell encapsulating the core.

A detailed description is given in the following embodiments.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The method for forming the biomass chemical toner composition in the invention is an emulsion aggregation. First, the biomass resin and hydrophobic resin are mixed to form an emulsion having organic particles. In one embodiment, the biomass resin and the hydrophobic resin have a weight ratio of about 25:75 to 85:15. The overly high biomass resin ratio will increase the moisture adsorption ratio of the toner product, and the toner having overly low biomass resin ratio cannot be called biomass material because it does not meet the biomass definition (e.g. including at least 20% of biomass compound).

The biomass resin can be poly(lactic acid), polycaprolactone, polyhydroxyalkanoate, or mixtures thereof. The weight-average molecular weight (Mw) of the biomass resin ranges from 3,000 to 120,000. The overly high biomass Mw will be difficult to process, and the overly low biomass Mw will make the toner product being easily humidity-absorbing and offset in print.

The hydrophobic resin may improve the toner's ability to fuse with paper or be applied on the surface of the biomass particles to form a shell, such that the charge instability of the toner due to moisture adsorption can be efficiently avoided. To enhance the toner fusing and to restrain its offset, two hydrophobic resins having different Mw are selected to be mixed, wherein one hydrophobic resin has an Mw of 5,000 to 30,000, preferably of 10,000 to 20,000; and another hydrophobic resin has an Mw of 40,000 to 70,000, preferably 50,000 to 60,000. The mixing ratio between these hydrophobic resins is optional, according to product requirement. In general, the low Mw hydrophobic resin and the high Mw hydrophobic resin have a weight ratio of 1:9 to 8:2, preferably of 2:8 to 5:5. The described hydrophobic resin has a mean degree of polymerization of 1.2 to 4.3, preferably of 1.2 to 3.8. Because the fusing property and the aggregation step in preparation of the toner are determined by the glass transition temperature (Tg) of the hydrophobic resin, the hydrophobic resin Tg is controlled to 45° C. to 85° C., preferably to 55° C. to 65° C. In one embodiment, the hydrophobic resin can be acrylate based copolymer, and the monomer of the acrylate based copolymer includes methacrylate such as methyl methacrylate, phenyl methacrylate, ethyl methacrylate, 2-hydroxylethyl methacrylate, hydroxylpropyl methacrylate, or butyl methacrylate, or acrylate such as methyl acrylate, phenyl acrylate, ethyl acrylate, 2-hydroxylethyl acrylate, hydroxylpropyl acrylate, or butyl acrylate. The acrylate based copolymer may further include a monomer such as styrene, methyl styrene, and the likes. When the hydrophobic resin is the acrylate based copolymer, it can be interpenetrating network (in abbreviate IPN) polymerized with the biomass resin. The poly(lactic acid), the above acrylate monomer, and the thermal initiator such as azo-bis-isobutryonitrile (in abbreviate AIBN) are simultaneously dissolved in a solvent such as acetone or dichloromethane to process IPN polymerization. A surfactant and water are sequentially added to the IPN copolymer, and the mixture is then stirred to form an emulsion.

In another embodiment, the hydrophobic resin can be polyester. The polyester is formed by condensation polymerization of phthalic acid and diol, wherein 7% to 12% of the phthalic acid contains a sodium sulfonate group, and diol includes ethylene glycol or 1,2-propanediol. When the hydrophobic resin is the polyester, it can be mixed with the biomass resin by general polymer blending. The poly(lactic acid), the polyester or the acrylate based copolymer, and the surfactant are simultaneously dissolved in a solvent such as acetone or dichloromethane, and heated to be fully dissolved the mixture in the solution. Water is slowly added to the blend to form a mixture, and the mixture is stirred to form an emulsion.

The emulsion containing the biomass resin, the hydrophobic resin emulsion, the hydrophilic pigment dispersion, and the hydrophilic wax emulsion are thoroughly mixed, and the pH of the mixture is tuned to be acidic such as 4. A flocculant is added to the acidic mixture which is then stirred at high speed by a homogenizer for 10 minutes, and then added to a reactor for stirring at 250 rpm to form an emulsion of core particles. The core diameter can be controlled by reaction temperature, reaction period, stirring speed, and pH value. The core particles will have a larger diameter through the aggregation with higher reaction temperatures, lower pH value, longer reaction period, and/or slower stirring speed. The emulsion aggregation temperature for forming the core particles is between 30° C. to 60° C., preferably 45° C. to 55. The overly low reaction temperature cannot efficiently form the particles, and the overly high reaction temperature will dramatically increase the aggregation rate and therefore forming too large core particles. The emulsion aggregation period for forming the core particles ranges from between one half hour to eight hours. The overly short reaction period cannot efficiently form the particles, and the overly long reaction period will be time-consuming and therefore forming too large core particles. The emulsion aggregation stirring speed to form the core particles is between 50 rpm to 500 rpm. The overly fast stirring speed will form too small core particle, and the overly slow stirring speed will broaden the diameter distribution of the core particles. The emulsion aggregation pH value for forming the core particles is 3 to 7. If the pH value is below 3, the aggregation will be too fast and out of control. If the pH value is higher than 7, it will not efficiently aggregate to form the particles.

The wax emulsion is formed by dispersing the wax in an anionic surfactant or a cationic surfactant. The selection of wax includes polyethylene wax, rice wax, carnauba wax, or combinations thereof, preferably rice wax or carnauba wax. In one embodiment, the wax emulsion is Petrolite® 1417 commercially available from Baker. The wax may help the toner release from the heat roller while it is thermal fused on the paper. The wax has 3 parts by weight to 10 parts by weight based on 100 parts by weight of the organic particles (composed of the biomass and the hydrophobic resin). The overly high wax ratio will lower the thermal resistance and reduce the storage period of the toner, and the overly low wax ratio will make the release effect being insufficient.

The pigment provides the toner with color options. The pigment makes up between 3 parts by weight to 10 parts by weight of the toner based on 100 parts by weight of organic particles (composed of the biomass and the hydrophobic resin). If the pigment ratio is too much, it will be difficult to fuse the toner. If the pigment amount is too low, the color saturation of the toner will be insufficient. The major pigment color of the toner includes black, yellow, magenta, and cyan. In practice, at least two of the pigments can be combined to enhance the color saturation and chromaticity. A suitable pigment for the toner may adopt organic pigments including magenta pigment such as C. I. Pigment Red 122, C. I. Pigment Red 202, C. I. Pigment Red 206, C. I. Pigment Red 209, C. I. Pigment Red 177, C. I. Pigment Red 254, or C. I. Pigment Red 269; yellow pigment such as C. I. Pigment Yellow 13, C. I. Pigment Yellow 155, C. I. Pigment Yellow 119, C. I. Pigment Yellow 138, Pigment Yellow 139, or C. I. Pigment Yellow 168; cyan pigment such as C. I. Pigment Blue 15:3, C. I. Pigment Blue 15:4, or C. I. Pigment Blue 15:6; black pigment such as Pigment Black 7. In one embodiment, the pigment can be LFF-MA7, LFF-MA100, HCF-#2650, or MCF-88 commercially available from Mitsubishi Chemical; Special 4A or FW-18, commercially available from Degussa Co.; S90B or Mogul L commercially available from Cabot, or RAVEN1200 or RAVEN2000, commercially available from Columbian.

To control pigment diameter distribution and compatibility of the pigment and the resin emulsion, the pigment can be pre-dispersed by a surfactant or a polymer dispersant. The suitable surfactant in the invention includes anionic surfactants such as sodium dodecyl sulfate, sodium lauryl sulfate, sodium dodecylbenzene sulfonate, sodium dodecylnaphthalene sulfonate, dialkylbenzenealkyl sulfate, dialkylbenzenealkyl sulfonate, abitic acid (commercially available from Aldrich), NEOGEN SC-F commercially available from KAO Chemical, or Lipal 860K commercially available from Lion. The suitable surfactant for the invention includes cationic surfactant such as alkylbenzyl dimethyl ammonium chloride, dialkylbenzyl dimethyl ammonium chloride, lauryltrimethyl ammonium chloride, alkylbenzyl methyl ammonium chloride, alkylbenzyl dimethyl ammonium bromide, benzalkonium chloride, cetylpyridine bromide, $C_{12}$,$C_{15}$,$C_{17}$-trimethyl ammonium bromide, quaternized polyethyleneoxyalkylamino halide, dodecylbenzyl triethyl ammonium chloride, SANIZOL™ commercially available from KAO Chemical, or Levenol RC-1214 commercially available from KAO Chemical. The suitable surfactant of the invention can be a non-ionic surfactant such as polyethyleneoxy cetyl ether, polyethyleneoxy octylphenyl ether, polyethyleneoxy octyl ether, polyethyleneoxy oleyl ether, polyethyleneoxy sorbitan monolaurate, polyethyleneoxy stearyl ether, polyethyleneoxy nonylphenyl ether, dialkylphenoxypoly(ethyleneoxy) ethanol, IGEPAL CA-210, IGEPAL CA-520, IGEPAL CA-720, IGEPAL CO-890, IGEPAL CO-720, or IGEPAL CO-290 commercially available from SHOWA, ANTAROX 890 or ANTAROX 897 commercially available from Rhodia, or TERGITOL 15-S-40 commercially available from DOW Chemical. The suitable surfactant can be polymer dispersant such as Solsperse 27000 commercially available from Avecia. In one embodiment, the dispersant and the pigment have a weight ratio of 1:100 to 100:100, preferably of 10:100 to 50:100. The overly high dispersant (surfactant)

amount will increase the viscosity of the pigment dispersion too much, and the overly low dispersant (surfactant) amount will make the pigment dispersion being unstable.

The flocculant is applied to control the diameter of the aggregated particles. The flocculant includes a water soluble small molecular amine such as ethylenediamine, diethylenetriamine, triethylenetetramine, tetraethylenepentamine, or isophoronyldiamine; or organic aliphatic amino ester such as 4-aminobutyl ester, tert-amino ester, amino sulfate, or amino sulfonate. The flocculant of the invention also includes inorganic compounds such as zinc acetate, magnesium acetate, poly aluminum chloride, calcium chloride, or magnesium chloride. The flocculant has an amount of 0.01 to 1 parts by weight based on 100 parts by weight of the organic particles (composed of the biomass and the hydrophobic resin). The overly high flocculant amount will increase the toner diameter too much, and the overly low flocculant amount will complicates the aggregation of the core particles.

The emulsion of the core particles is stirred, and the hydrophobic resin emulsion is slowly added to the emulsion which is then slowly heated to 55, and continuously stirred for 1 to 2 hours at 55° C., such that the hydrophobic resin forms a shell encapsulating the surface of the core particles. When the average diameter of the core-shell particles grows to 7 μm, the pH value of the reaction is tuned to be basic levels such as 8 to stop the reaction. As such, the toner particles having core-shell structure are obtained. The basic emulsion is slowly heated to 80° C. to 100° C., preferably 85° C. to 95° C., and stirred for 4 to 5 hours to heat and coalesce the hydrophobic resin of the shell, thereby forming a continuous shell encapsulating the core. If the temperature of the heating and coalescing step is too low, the surface of the toner particles will not be regular and spherical. If the temperature of the heating and coalescing step is too high, the different toner particles will melt and coalesce to form larger particles. The emulsion of the toner is cooled to 30° C. and pH thereof is tuned to acidic levels such as 4, filtered, washed, and dried to obtain the biomass chemical toner.

Accordingly, the nano or sub-micro scaled poly(lactic acid) emulsion, the pigment dispersion, and the wax dispersion are chemical aggregated to form core particles. The hydrophobic resin emulsion is subsequently added to the emulsion of the core particles to form a shell on the surface of the core particles. The core-shell structure is melted and coalesced to form a toner having a regular and spherical shape by tuning the pH value and the temperature. The method of the invention only uses a small amount of organic solvent to form the toner which has a lower melting temperature, and the toner can be fused to the paper at lower temperatures. As such, the toner of the invention meets energy efficiency requirements as well as higher environmental protection standards. In addition, the core-shell structure of the toner has better anti-humidity and charge stability properties. The particle diameter of the toner can be controlled by the surfactant amount, the stirring speed, the aggregation time, and the emulsion concentration, such that the toner has a smooth shape, smaller diameter, narrower diameter distribution, and better flow ability to satisfy modern printing requirements (e.g. fast, clear, and colorful).

Compared with conventional kneader methods, the chemical process of the invention consumes less energy, thereby reducing cost and environmental loading. The chemical process of the invention is easier to perform than the kneader method, and the toner manufactured from the chemical process has an extra small diameter distribution range within 7±2 μm. The narrower diameter distribution of the toner does not need additional classification, and the production of the toner is economical and environmentally friendly. Accordingly, the diameter distribution of the toner is exactly controlled in the invention. Note that the chemical toner being developed at low temperature may largely enhance the thermal fusing efficiency; it will reduce power consumption. The chemical toner is more environmentally friendly than the traditional toner; it reduces environmental loading by reducing 40% emission of $CO_2$, nitride, and sulfide in manufacturing and utilizing the same.

EXAMPLES

To understand the property difference of the toner, the raw resins were analyzed to determine their weight-average molecular weight (Mw), glass transition temperature (Tg), and melting point.

The weight-average molecular weight of the resin was measured using the method below: dissolving the resin in THF to form a 0.2 wt % solution, filtering the resin solution with a film having a pore size of 0.2 μm, and analyzing the filtered solution by a gel permeation chromatography (Model 600, commercially available from Waters) with columns of Shodex KF-802.5, KF-803, KF-804, and KF-805. In the GPC analyze, the eluent was THF, the column temperature was 40° C., the detector temperature was 35° C., the sample loading was 150 μL, and the eluent flow rate was 1.0 mL/min.

The Tg and the melting point (Tm) of samples were measured as below: 5 mg to 10 mg of sample was charged in a sample pan and compressed to seal the sample, and the sealant was then installed into an instrument DSC 7 (commercially available from Perkin Elmer). The thermal analyze began at 40° C. for 1 minute, then heated to 200° C. at a rate of 20° C./min, cooled to 40° C. in a rate of −20° C./min, stayed at 40° C. for 3 minutes, and then heated to 200° C. at a rate of 20° C./min, thereby obtaining the Tg and Tm of the sample.

The toner properties were evaluated by the diameter, water content ratio, and moisture absorption ratio thereof. The toner having diameter less than 2 μm was measured by scattering, and the toner having larger diameter was measured by an electron microscope. The dynamic light-scattering particle size analyzer LB-500 (commercially available from HORIBA), and the scanning electron microscope (SEM) S-4200 (commercially available from Hitachi) were used.

The water content ratio of the toner was measured according to the method below: an aluminum dish was weighted (A). About 2 g of the toner was charged on the aluminum dish to weigh the total weight (B). The toner on the aluminum dish was installed into an oven at 105° C. for 2 hours to remove water thereof, and then transferred to a dry box to cool. The total weight of the dried toner and the aluminum dish was weighted (B*), and the water content ratio of the toner was calculated by formula: $(B-B^*)/(B^*-A)\times 100\%$.

The moisture adsorption ratio of the toner was measured as below: an aluminum dish was weighed (A). About 2 g of the toner was charged on the aluminum dish and placed in an oven at 105° C. for 2 hours to remove water thereof and then transferred to a dry box to cool. The total weight of the dried toner and the aluminum dish was weighed (B*), and then installed to a constant temperature (35° C.) and constant humidity (85% relative humidity) box for 48 hour. The total weight of the toner adsorbing humidity and the aluminum dish was weighed (B), and the moisture adsorption ratio of the toner was calculated by formula: $(B^{}-B^*)/(B^*-A)\times 100\%$.

Preparation Example 1

Preparing the Organic Particle by Inter-Penetrating Polymerization 551 g of dichloromethane and 74.5 g of PLA (B-400, commercially available from TOYOBO) were charged in a 1000 mL reaction bottle under nitrogen. The mixture was stirred and heated to 50° C. to dissolve the PLA. Next, 84.848 g of methyl methacrylate (commercially available from ACROS), 24.208 g of butyl acrylate (commercially available from ACROS), 2.78 g of methacrylic acid (SHOWA), 1.678 g of dodecanethiol (commercially available from ACROS), and 1.678 g of AIBN were fully stirred for 10 minutes, was then added to the PLA solution. The mixture was heated to 80° C. and reacted at 80° C. for 7 hours. The reaction was cooled to room temperature at the end, thereby obtaining an inter-penetrated network (IPN) polymer of the PLA and the acrylate based copolymer. The IPN polymer solution was slowly added to the 600 g aqueous solution of 6 g sodium dodecyl sulfate (commercially available from SHOWA), and the mixture was emulsified by a high speed emulsion machine for 10 minutes. The dichloromethane of the emulsion was then removed by vacuum distillation, and the emulsion of the IPN polymer of the PLA and the acrylate based copolymer was obtained. The described emulsion had a solid content (the organic particles) of 28%, the PLA and the acrylate based copolymer had a weight ratio of 67:33, and the organic particles had an average diameter of 148 nm. The acrylate based copolymer had an Mw of 184430, and PLA had an MW of 27465.

Preparation Example 2

Preparing the Organic Particle by Blending

The polyester in this preparation was LIV (commercially available from ShinKong) formed by condensation polymerization of phthalic acid and 1,2-propanediol, wherein 7% of the phthalic acid contains a sodium sulfonate group. The polyester had an MW of 6899, a Tg of 51° C.

10.8 g of the polyester LIV, 9.2 g of PLA, and 4 g of sodium dodecyl sulfate were added to 40 g of dichloromethane, the mixture was heated until totally dissolved. 500 g of water was added to the solution and stirred to form an emulsion. 50 g of acetone was slowly added to the emulsion which was then stirred at 8000 rpm by a homogenizer in an ice bath for 30 minutes. Thereafter, the dichloromethane and acetone of the emulsion were removed by vacuum distillation, thereby forming an aqueous emulsion of the organic particles blended by the PLA and the polyester. The organic particles had a diameter of 58 nm, and the emulsion had a solid content (the organic particles) of 5.8%.

Preparation Example 3

Preparing the Hydrophobic Acrylate Resin Emulsion 1.435 g of sodium dodecyl sulfate (commercially available from SHOWA), 399.23 g of de-ionized water, 441.21 g of styrene (commercially available from ECHO), 121.04 g of butyl acrylate (commercially available from ACROS), 13.89 g of methacrylic acid (commercially available from SHOWA), and 15.30 g of dodecanethiol (commercially available from ACROS) were fully stirred by high speed stirrer for 10 minutes to form a monomer solution. 99.21 g of the monomer solution was charged into a reactor and heated to 70° C. The 8.05 g of pre-dissolved initiator ammonium persulfate (commercially available from SHOWA) and 40 g of deionization water were added to the heated monomer solution to form a mixture. Subsequently, the remainder monomer solution was slowly added to the mixture in 2 hours for reaction. The reaction temperature was controlled at 80° C. After the remaining monomer solution was added to the reaction, the reaction was continued for another 4 hours. The reaction was slowly cooled to room temperature to form the emulsion of the acrylate based copolymer, wherein the emulsion had a solid content of 35%. In the emulsion, the particle diameter was 84 nm, the Mw of the copolymer was 14,010, the Mn of the copolymer was 1,987, and the Tg of the copolymer was 55.8° C.

Preparation Example 4

Preparing the Hydrophobic Polyester Resin Emulsion 160 g of water was added to 40 g of the polyester of Preparation Example 2, and the mixture was heated to 90° C. to be totally dissolved. The solution was cooled to room temperature to form an emulsion. The emulsion had a solid content of 20.0%, and the particle diameter thereof was 123 nm.

Preparation 5

Preparing Hydrophilic Pigment Dispersion

A grind jar (250 mL, PE) was half-filled with zirconium balls having a diameter of 1 mm. 5 g of the pigment in Table 1, 100 g de-ionized water, 0.5 g of grinding aid agent DP-16 (commercially available from DEUCHEN®, and 1 g of surfactant SANIZOL B50 (commercially available from Kao Chemical) were added to the grind jar. The mixture in the grind jar was dispersed by a grinding machine (commercially available from Red Devil Equipment Co.) for 4 hours, and filtered to remove the grinding ball to obtain the pigment dispersion. The solid particle diameter in the dispersion was measured by a light scattering apparatus ELS-800 (commercially available from OTSUKA) and tabulated in Table 1.

TABLE 1

The result of the pigment dispersed by the surfactant

| No. | Pigment | particle size(nm) |
|---|---|---|
| SBk-1 | Carbon Black (Cabot ® MOGUL L) | 103.8 |
| SC-1 | Pigment blue 15:3 (Clariant) | 105.5 |
| SM-1 | Pigment Red 122 (Clariant) | 98.8 |
| SY-1 | Pigment Yellow 155 (Clariant) | 115.7 |

Example 1

40 g of the emulsion of Preparation Example 1 and 7.6 g of the emulsion of Preparation Example 3 were mixed in 10 g de-ionized water, and the pH of the mixture was tuned to 8. The mixture was stirred at 800 rpm at room temperature for 5 minutes, 7 g of the wax dispersion Petrolite® 1417 (commercially available from Baker) and 9.5 g of the black pigment dispersion (SBk-1) were added to, and then stirred at room temperature for 10 minutes. 7.41 g of 5% sodium dodecyl sulfate (commercially available from SHOWA) aqueous solution was then added to the mixture, and the pH of the mixture was tuned to 4 by 10% nitric acid. 15 g of 0.5% poly aluminum chloride aqueous solution was added to the acidic mixture and stirred for 5 minutes. As such, the pigment, wax, the organic particles of Preparation Example 1, and the acrylate based copolymer particles of Preparation Example 3 were aggregated to form the core particles.

Subsequently, 7.6 g of the hydrophobic resin emulsion of Preparation Example 3 was added to the core particles to encapsulate them. The reaction was slowly heated to 55° C. and remained at 55° C. for 3 hours. After the particle diameter grew to about 6 μm, the pH of the reaction was tuned to 7. As such, the core particles was encapsulated by the hydrophobic resin of Preparation Example 3. Thereafter, the neutralized reaction was heated to 85° C. and remained at 85° C. for 8 hours, such that the hydrophobic resin of the shell was heated and coalesced to a continuous structure. The described core-shell structure particles were collected by filtering and then dried to obtain a black toner, and the properties of this black toner were tabulated in Table 2.

Example 2

Similar to Example 1, the only difference of the Example 2 was that the black pigment dispersion (SBk-1) was replaced by the blue pigment dispersion (SC-1).

Example 3

246 g of the emulsion of Preparation Example 2 and 7.6 g of the emulsion of Preparation Example 3 were mixed in 10 g of de-ionized water, and the pH of the mixture was tuned to 8. The basic mixture was stirred at 800 rpm at room temperature for 5 minutes, 7 g of the wax dispersion Petrolite® 1417 (commercially available from Baker) and 9.5 g of the yellow pigment dispersion (SY-1) were added to, and stirred at room temperature for 10 minutes. 7.41 g of 5% sodium dodecyl sulfate (commercially available from SHOWA) aqueous solution was then added to the mixture, and the pH of the mixture was tuned to 4 by 10% nitric acid. 15 g of 0.5% poly aluminum chloride aqueous solution was added to the acidic mixture and stirred for 5 minutes. As such, the pigment, wax, organic particles of Preparation Example 2, and the acrylate based copolymer particles of Preparation Example 3 aggregated to form the core particles.

Subsequently, 7.6 g of the hydrophobic polyester resin emulsion of Preparation Example 4 was added to the core particles to encapsulate them. The reaction was slowly heated to 55° C. and remained at 55° C. for 3 hours. After the particle diameter grew up to about 6 μm, the pH of the reaction was tuned to 7. As such, the core particles was encapsulated by the hydrophobic polyester resin of Preparation Example 4. Thereafter, the neutralized reaction was heated to 85° C. and remained at 85° C. for 8 hours, such that the hydrophobic polyester resin of the shell was heated and coalesced to a continuous structure. The described core-shell structure particles were collected by filtering and then dried to obtain a yellow toner, and the properties of this yellow toner were tabulated in Table 2.

Example 4

Similar to Example 3, the only difference of the Example 4 was that the yellow pigment dispersion (SY-1) was replaced by the red pigment dispersion (SM-1).

Comparative Example 1

246 g of the emulsion of Preparation Example 2 and 7.6 g of the emulsion of Preparation Example 3 were mixed in 10 g de-ionized water, and the pH of the mixture was tuned to 8. The mixture was stirred at 800 rpm at room temperature for 5 minutes, 7 g of the wax dispersion Petrolite® 1417 (commercially available from Baker) and 9.5 g of the blue pigment dispersion (SC-1) were added to, and stirred at room temperature for 10 minutes. 7.41 g of 5% sodium dodecyl sulfate (commercially available from SHOWA) aqueous solution was then added to the mixture, and the pH of the mixture was tuned to 4 by 10% nitric acid. 15 g of 0.5% poly aluminum chloride aqueous solution was added to the acidic mixture which was then stirred for 10 minutes. As such, the pigment, wax, the organic particles of Preparation Example 2, and the acrylate based copolymer of Preparation Example 3 aggregated to form the core. Subsequently, the core dispersion was slowly heated to 55° C. and remained at 55° C. for 3 hours. After the particle diameter grew to about 6 μm, the pH of the reaction was tuned to 7. Thereafter, the neutralized reaction was heated to 85° C. and remained at 85° C. for 8 hours, such that the core was heated and coalesced. The described core without shell particles were collected by filtering and then dried to obtain a blue toner, and the properties of this blue toner were tabulated in Table 2.

Comparative Example 2

10 g of de-ionized water was added to 246 g of the emulsion of Preparation Example 2 and the pH of the mixture was tuned to 8. The basic mixture was stirred at 800 rpm at room temperature for 5 minutes, 7 g of the wax dispersion Petrolite® 1417 (commercially available from Baker) and 9.5 g of the blue pigment dispersion (SC-1) were added to, and stirred at room temperature for 10 minutes. 7.41 g of 5% sodium dodecyl sulfate (commercially available from SHOWA) aqueous solution was added to the mixture, and the pH of the mixture was tuned to 4 by 10% nitric acid. 15 g of 0.5% poly aluminum chloride aqueous solution was added to the acidic mixture and stirred for 10 minutes, and then slowly heated to 95° C. However, the pigment, wax, and the organic particles of Preparation Example 2 could not aggregate to the proper shape even when reacted at 95° C. for 16 hours or longer. The properties of this result were tabulated in Table 2.

TABLE 2

| | Shape | Diameter (μm) | Water content | Moisture adsorption ratio |
|---|---|---|---|---|
| Example 1 | Regular and Spherical | 6.8 | 3.023% | 1.59% |
| Example 2 | Regular and Spherical | 6.5 | 1.356% | 0.81% |
| Example 3 | Regular and Spherical | 7.2 | 1.041% | 0.62% |
| Example 4 | Regular and Spherical | 7.5 | 1.13% | 0.40% |
| Comparative Example 1 | Concave and convex surface | 7.3 | 7.352% | 5.55% |
| Comparative Example 2 | Unshaped | <3 | Not available | Not available |

As shown in Table 2, the moisture adsorption ratio of the biomass toner was efficiently controlled by the core-shell structure. As such, the invention is effective and practical.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A biomass chemical toner composition, comprising:

a core; and a shell encapsulating the core, wherein the shell is a continuous structure;

wherein the core is a mixture of an organic particle, a second hydrophobic resin, and a pigment, wherein the organic particle is composed of a biomass resin and a first hydrophobic resin; and wherein the shell is composed of a third hydrophobic resin, wherein the biomass resin and the first hydrophobic resin in the organic particle have a weight ratio of 25:75 to 85:15.

2. The biomass chemical toner composition as claimed in claim 1, wherein the biomass resin comprises poly(lactic acid), polycaprolactone, polyhydroxyalkanoate, or mixtures thereof.

3. The biomass chemical toner composition as claimed in claim 1, wherein the biomass resin has a weight-average molecular weight of 3,000 to 120,000.

4. The biomass chemical toner composition as claimed in claim 1, wherein the first hydrophobic resin comprises polyester, and the organic particle is a blend of the biomass resin and the polyester.

5. The biomass chemical toner composition as claimed in claim 1, wherein the first hydrophobic resin comprises acrylate based copolymer, and the organic particle is an interpenetrated product of the biomass resin and the acrylate based copolymer.

6. The biomass chemical toner composition as claimed in claim 1, wherein the first hydrophobic resin is composed of a resin having a weight-average molecular weight of 5,000 to 30,000 and another resin having a weight-average molecular weight of 40,000 to 70,000.

7. The biomass chemical toner composition as claimed in claim 1, wherein the second hydrophobic resin comprises acrylate based copolymer.

8. The biomass chemical toner composition as claimed in claim 1, wherein the second hydrophobic resin is composed of a resin having a weight-average molecular weight of 5,000 to 30,000 and another resin having a weight-average molecular weight of 40,000 to 70,000.

9. The biomass chemical toner composition as claimed in claim 1, wherein the third hydrophobic resin comprises polyester or acrylate based copolymer.

10. The biomass chemical toner composition as claimed in claim 1, wherein the third hydrophobic resin is composed of a resin having a weight-average molecular weight of 5,000 to 30,000 and another resin having a weight-average molecular weight of 40,000 to 70,000.

11. The biomass chemical toner composition as claimed in claim 1 having a diameter around 7 μm.

12. The biomass chemical toner composition as claimed in claim 1, wherein the core and the shell have a weight ratio of 50:50 to 95:5.

13. The biomass chemical toner composition as claimed in claim 1, wherein the organic particle and the pigment have a weight ratio of 100:3 to 100:10.

14. A method for preparing the biomass chemical toner composition, comprising:

forming an organic particle of a biomass resin and a first hydrophobic resin;

mixing the organic particle, a second hydrophobic resin, and a pigment to form a core;

forming a third hydrophobic resin on the surface of the core; and heating and coalescing the third hydrophobic resin to form a continuous shell encapsulating the core, wherein the biomass resin and the first hydrophobic resin in the organic particle have a weight ratio of 25:75 to 85:15.

15. The method as claimed in claim 14, wherein the first hydrophobic resin is acrylate based copolymer, and the organic particle is formed by inter-penetrating polymerization.

16. The method as claimed in claim 14, wherein the first hydrophobic resin is polyester, and the organic particle is formed by polymer blending.

17. The method as claimed in claim 14, wherein the second hydrophobic resin is polyester or acrylate based copolymer.

18. The method as claimed in claim 14, wherein the step of mixing the organic particle, the second hydrophobic resin, and the pigment to form the core is processed carried out by emulsion aggregation, and a wax dispersion and a flocculant is are further added to the emulsion aggregation.

19. The method as claimed in claim 18, wherein the wax dispersion comprises polyethylene wax, rice wax, carnauba wax, or combinations thereof.

20. The method as claimed in claim 18, wherein the flocculant comprises metal chloride, polymeric quaternary ammonium salt, or combinations thereof.

21. The method as claimed in claim 14, wherein the step of mixing the organic particle, the second hydrophobic resin, and the pigment to form the core is carried out at a temperature of 30° C. to 60° C.

22. The method as claimed in claim 14, wherein the step of heating and coalescing the third hydrophobic resin to form the continuous shell encapsulating the core is carried out at a temperature of 80° C. to 100° C.

23. The method as claimed in claim 14, wherein the step of mixing the organic particle, the second hydrophobic resin, and the pigment to form the core and the step of heating and coalescing the third hydrophobic resin to form the continuous shell encapsulating the core have a pH of less than 7.

24. The method as claimed in claim 14, after the step of forming the third hydrophobic resin on the surface of the core, further comprising a step of tuning the pH greater than 7 to stop the reaction.

* * * * *